US007057484B2

(12) United States Patent
Gilmore

(10) Patent No.: US 7,057,484 B2
(45) Date of Patent: Jun. 6, 2006

(54) REED SWITCH DEVICE AND METHOD OF USING SAME

(76) Inventor: Glendell N. Gilmore, P.O. Box 690851, Houston, TX (US) 77269-0851

( * ) Notice: Subject to any disclaimer, the term of this patent is extended or adjusted under 35 U.S.C. 154(b) by 81 days.

(21) Appl. No.: 10/369,005

(22) Filed: Feb. 19, 2003

(65) Prior Publication Data

US 2005/0174204 A1 Aug. 11, 2005

(51) Int. Cl.
*H01H 3/16* (2006.01)

(52) U.S. Cl. ..... 335/205; 200/67.71

(58) Field of Classification Search ..... 335/205–207, 335/151–154; 160/10, 127, 133, 201, 310; 340/457, 547; 200/61.71–83, 61.62, 61.93
See application file for complete search history.

(56) References Cited

U.S. PATENT DOCUMENTS

| | | | | |
|---|---|---|---|---|
| 3,544,934 | A | 12/1970 | Poliakoff | |
| 3,975,723 | A * | 8/1976 | Bowling et al. | 340/547 |
| 4,210,889 | A | 7/1980 | Holce | |
| 4,232,309 | A * | 11/1980 | Dillitzer | 340/547 |
| 4,258,346 | A | 3/1981 | Williams | |
| 4,409,577 | A | 10/1983 | Holce et al. | |
| 4,465,997 | A | 8/1984 | Hines | |
| 4,988,965 | A | 1/1991 | Borja | |
| 5,243,325 | A | 9/1993 | Marin et al. | |
| 5,576,678 | A | 11/1996 | Saunders | |
| 5,589,811 | A | 12/1996 | Pariot et al. | |
| 5,633,626 | A | 5/1997 | Cawthorne | |
| 5,668,533 | A | 9/1997 | Jackson, Jr. et al. | |
| 5,713,621 | A * | 2/1998 | Krenkel et al. | 296/24.1 |
| 5,723,835 | A | 3/1998 | Gilmore | |
| 5,754,107 | A | 5/1998 | Ferrantelli | |
| 5,777,552 | A | 7/1998 | Fischette et al. | |
| 5,877,664 | A | 3/1999 | Jackson, Jr. | |
| 6,011,469 | A | 1/2000 | Taft et al. | |
| 6,225,903 | B1 | 5/2001 | Soloway et al. | |
| 6,249,224 | B1 | 6/2001 | Shoen et al. | |
| 6,348,861 | B1 | 2/2002 | Li | |
| 6,359,538 | B1 | 3/2002 | Jolley et al. | |
| 6,400,267 | B1 | 6/2002 | Gordon-Levitt et al. | |

OTHER PUBLICATIONS

*Introduction to the Digital Sensor*, http://www.crime-prevention-products.com/closet.htm, printed May 14, 2003, 1 page, (date of first publication, unknown).

(Continued)

*Primary Examiner*—Lincoln Donovan
(74) *Attorney, Agent, or Firm*—Douglas W. Rommelmann; Andrews Kurth LLP

(57) ABSTRACT

A reed switch device connects to a door facing of a door. The reed switch device includes an impact unit, adapted to stop movement of the door, and a reed switch. In one configuration, the reed switch device replace a pre-existing part on the door facing. In another configuration, the reed switch device is an adaptation of a pre-existing part on the door facing. Additional configurations include an impact unit, which receives a reed switch, and a kit which enables connection of the reed switch to the impact unit. Additionally, methods of installing a reed switch device to a door facing are disclosed In a first method, an impact unit with a reed switch is mounted to the door. In a second method a pre-existing part of the door is utilized. In a third method, a pre-existing part of the door of the door is adapted.

41 Claims, 11 Drawing Sheets

OTHER PUBLICATIONS

*Electric Door Light Switch*, http://www.smarthome.com/5188.html, printed May 14, 2003, 1 page, (date of first publication, unknown).

*Closet light and other night lights and other parts in electrical at AubuchonHardware.com*, http://electrical.aubuchonhardware.com/wiring_and_boxes/night_lights_and_other_parts/closet_light-514233.asp, printed May 14, 2003, 1 page, (date of first publication, unknown).

*Learn how to install an electric switch at AubuchonHardware.com by AubuchonHardware. . .*, http://electrical.aubuchonhardware.com/do_it_yourself_projects/how_to_install_an_electric_switch.asp, printed May 14, 2002, 8 pages, (date of first publication, unknown).

*Quick Switch*—p. 13, printed May 16, 2003, 1 page, (date of first publication, unknown).

*Door Alarm Detail, Roll-Up Door Contact*, ftp://216.89.18.228/web/draw/Roll_Up_Door_Contact_-.01.pdf printed May 16, 2003, 1 page, (date of first publication, Feb. 24, 1998).

* cited by examiner

FIG. 3
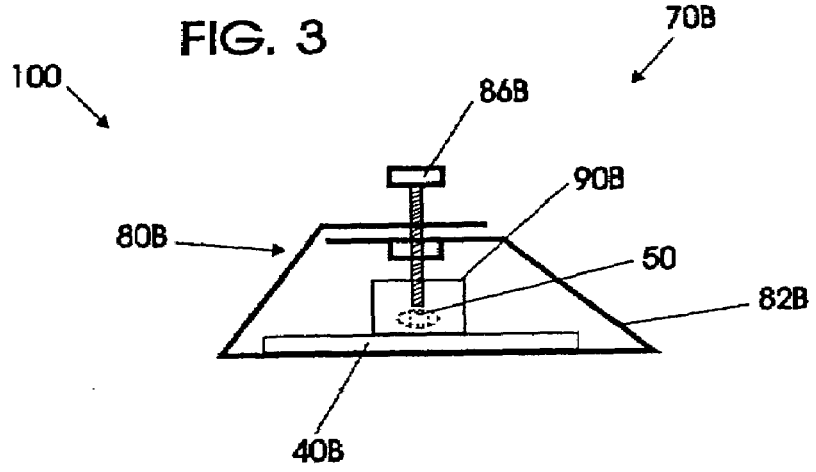
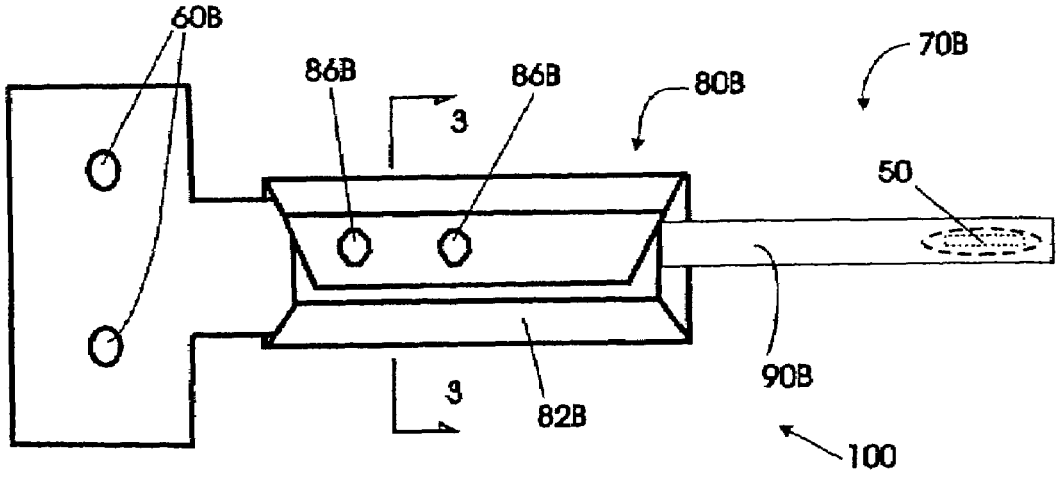
FIG. 2

FIG. 12
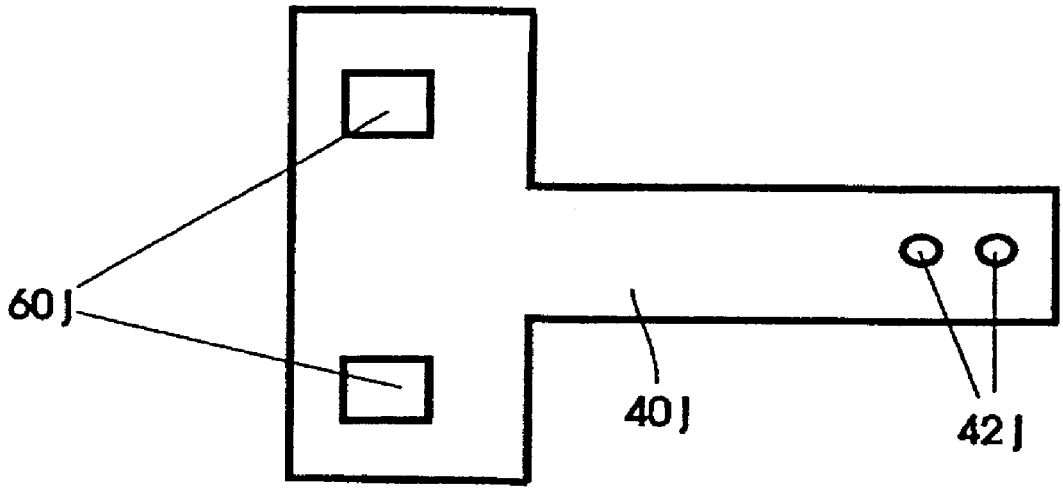
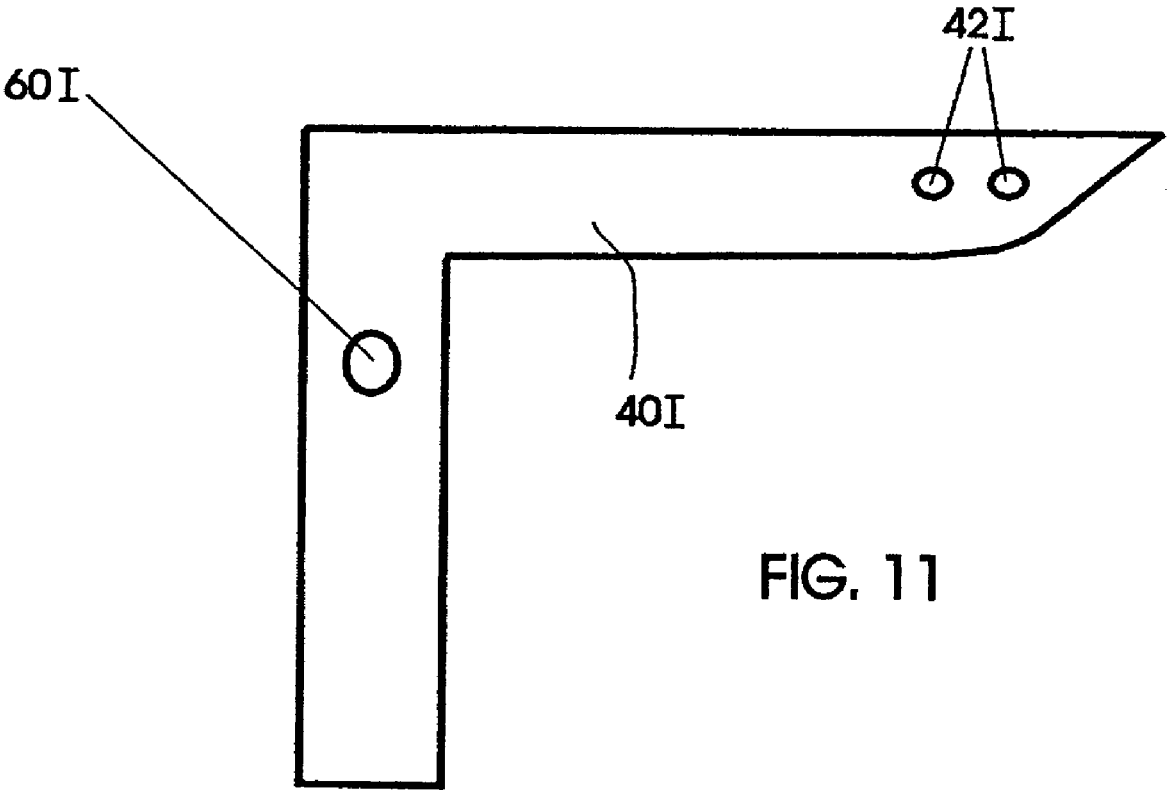
FIG. 11

FIG. 15
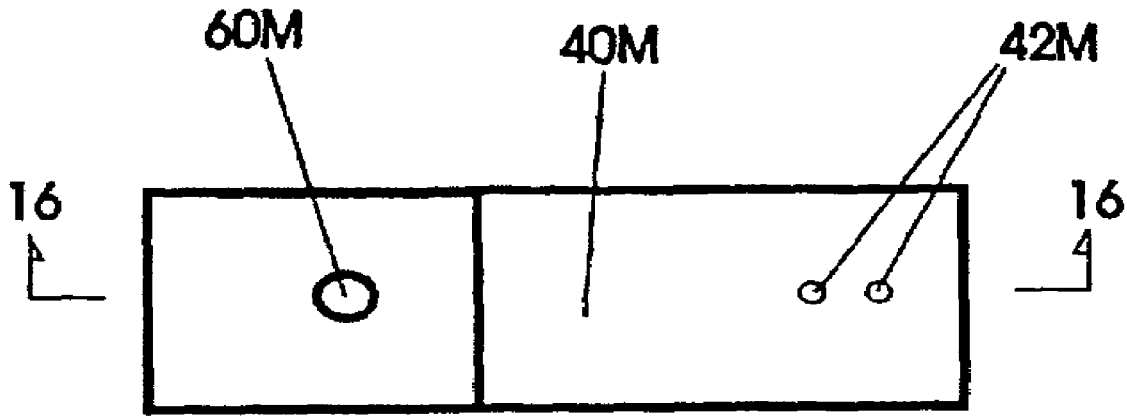
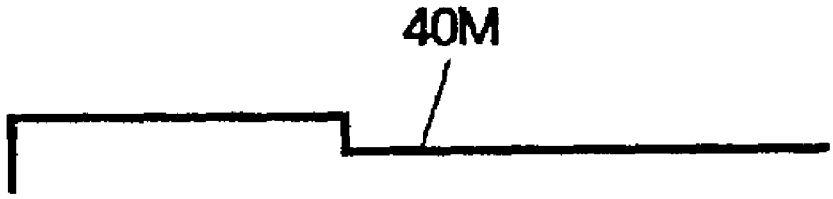
FIG. 16

FIG. 19
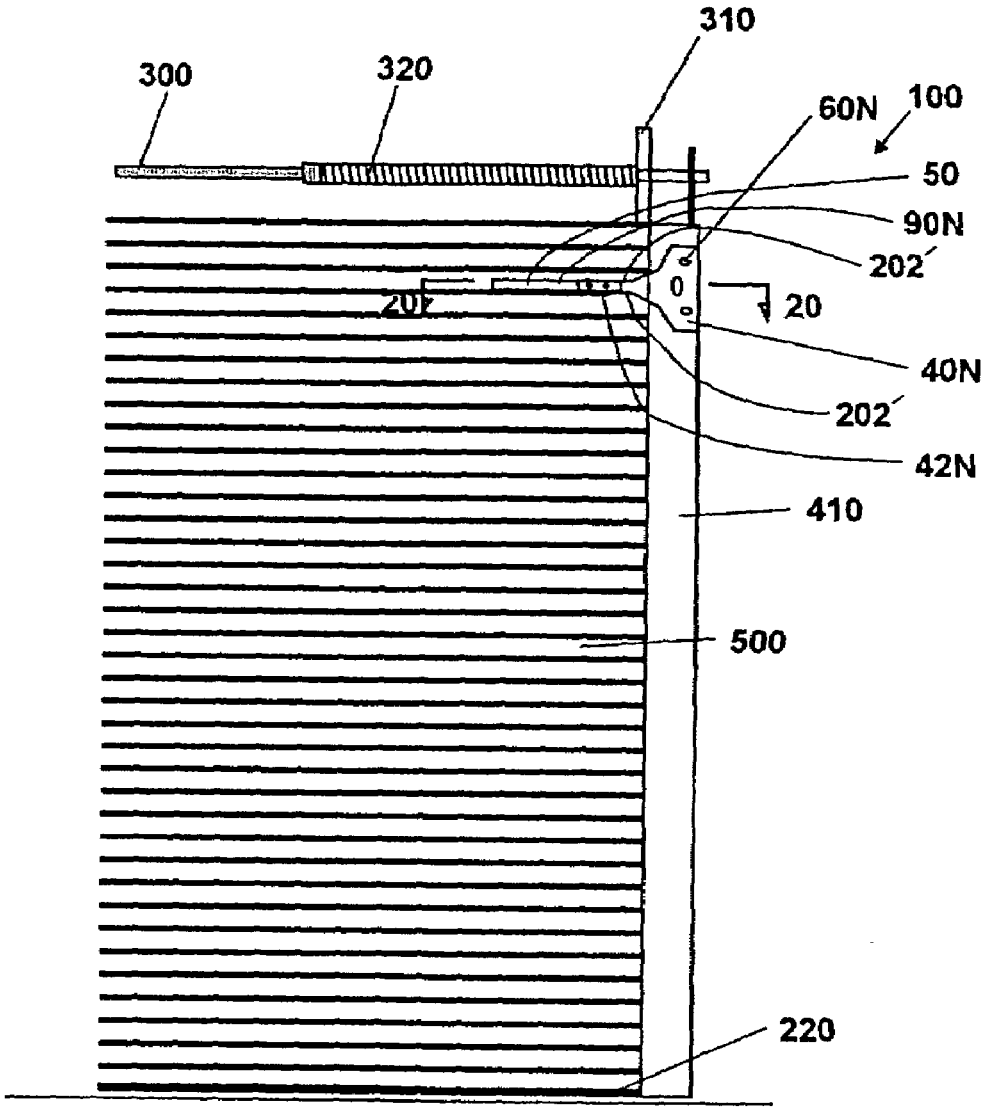
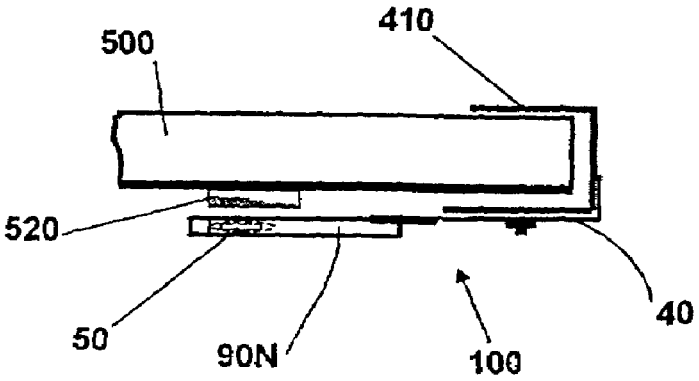
FIG. 20

REED SWITCH DEVICE AND METHOD OF USING SAME

CROSS-REFERENCE TO RELATED APPLICATIONS

Not Applicable.

STATEMENTS REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention relates generally to reed switches and methods of use, and more specifically to mounting arrangements and configurations.

2. Description of the Related Art

Reed switches are magnetically operated switches, which are generally formed by a pair of spaced ferromagnetic contacts or blades, hermetically sealed in a glass capsule. In a typical application and use of a reed switch, the blades are connected to outside leads—each outside lead being part of a circuit. The exposure of the blades to a magnetic field—coming from either a permanent magnetic or electromagnetic generation—forces the blades to move, either contacting one another or moving away from one another. In what is known as a normally closed reed switch ("Normal" in this sense and as will be used herein means a state where the reed switch is exposed to a magnetic field), the blades touch when exposed to a magnetic field. By removing the magnetic field, the normally closed reed switch opens and the contacts will no longer touch. Contrariwise, in a normally open reed switch, the contacts touch in the absence of a magnet. By exposing the normally open reed switch to the magnetic field, the contacts move apart and the circuit is opened. After the magnetic field has been removed from these reed switches, the blades will return to their original position.

Reed switches have been used in everything from computers and copying machines to automobiles and security systems. The general concept applied in the majority of these devices is the ability to activate a switch (that is, causing the ferromagnetic blade to move, be it closing the circuit or opening the circuit) via the use of a magnetic field. The activating of these switches allows communication to be established with systems or devices. In some instances the communication may be the lack of a signal or electrical energy being returned when the switch opens the circuit, while in other instances, the communication may be the circuit being completed. Examples include using a reed switch to automatically communicate with lights, air conditioning systems, power controlled devices and the like. As a specific use in security systems, reed switches have been used to monitor the "change of state" of something. For example, a reed switch can cause a circuit to be completed or broken when a window or door opens or closes. This change of condition (opening or closing of the circuit) can automatically be detected by a central alarm system or the like, indicating whether or not an unauthorized "change of state" has occurred. A typical security use of such a reed switch may be, for example, on a window or door of a house or on a roll-up door of a storage shed.

With the use of reed switches, several design considerations must be taken into account. Reed switches are by their very nature fragile—that is, the glass capsules can break. An exacerbation of their fragile nature is likelihood that forces may be imparted thereon. Therefore, in the design and installation of reed switches, the general trend is to place the reed switches in various locations that will not experience an impact or force. For example, on roll-up doors, the placement of reed switches (generally alarming the door) in these various locations (e.g., floor, door track, latch) has lead to an inconsistent placement of the reed switches. Additionally, many door manufacturers will not and have not provided a consistent location on their doors for the placement of a reed switch.

There have been various attempts by alarm installers to come up with a way to attach a reed switch and magnet to a roll-up door that will not degrade the normal functionality of the door. The prominent means of reed switch and magnet attachment has been drilling holes into the door facing (door track) and door curtain—then attaching screws. However, the door manufacturers did not design their doors for additional holes or screws (pop-rivets, bolts, etc.) to attach a reed switch. As such, side-effects of these invasive modifications to the door facing and door curtain have included a compromise to the normal opening and closing operation of the door and a greatly diminished cosmetic appeal of the door facing. The only other option of reed switch attachment has been with clamping devices that clamp to the roll-up door facing. With such an option, the magnet is also lined up adjacent to the clamping reed switch holder and screwed to the roll-up door curtain. However, clamping reed switch devices almost always move, get misaligned with the magnet, or completely fall off the door. The magnet is also very invasive to the door curtain and dangerous because of the sharp screws protruding through the door curtain.

Typically, the roll-up door is installed by the door installers. Then, the alarm company installs the reed switch. The roll-up door installer routinely returns to the job to repair the door after the alarm installer has installed the reed switch. Oftentimes, the door installers have to cut protruding reed switch mounting screws in an effort to obtain the normal function of the roll-up door. Alternatively, they have to readjust the door to attempt to get around the problems that the attachment of the reed switch imposed on the normal opening and closing operation of the door.

SUMMARY OF THE INVENTION

In a first embodiment of the invention, a reed switch device is adapted to couple to a portion of a door facing of a door. The reed switch device comprises an impact unit, adapted to stop movement of the door, and a reed switch. In a first configuration of the first embodiment, the reed switch device can utilize a pre-existing part on the door facing. In a second configuration of the first embodiment, the reed switch device is an adaptation of a pre-existing part on the door facing. A second embodiment of the invention includes a reed switch device, having an impact unit, adapted to stop the movement of the door, wherein a portion of the impact unit is adapted to couple with at least one reed switch. A third embodiment of the invention includes a kit, which utilizes a coupling apparatus to enable coupling of the reed switch to the impact unit. A fourth embodiment of the invention includes methods of installing a reed switch device. A first method of the fourth embodiment, comprises mounting an impact unit to the door facing with the impact unit adapted to stop the movement of the door and the impact unit having a reed switch coupled thereto. A second method of the fourth embodiment includes utilizing a pre-existing part of the door. A third method of the fourth embodiment includes adapting a pre-existing part of the door.

BRIEF DESCRIPTION OF THE SEVERAL VIEWS OF THE DRAWINGS

A better understanding of the present invention can be obtained when the following detailed description of the disclosed embodiments is considered in conjunction with the following drawings, in which:

FIG. 2 shows another embodiment of the invention, having a reed switch coupled to an impact unit;

FIG. 3 is a view taken along line 3—3 of FIG. 2;

FIGS. 7–15 shows several embodiments of the impact unit;

FIG. 16 is a view taken along line 16—16 of FIG. 15;

FIG. 19 shows an illustrative embodiment of the invention; and

FIG. 20 is a view taken along line 20—20 of FIG. 19.

DETAILED DESCRIPTION OF THE INVENTION

Figure 1:
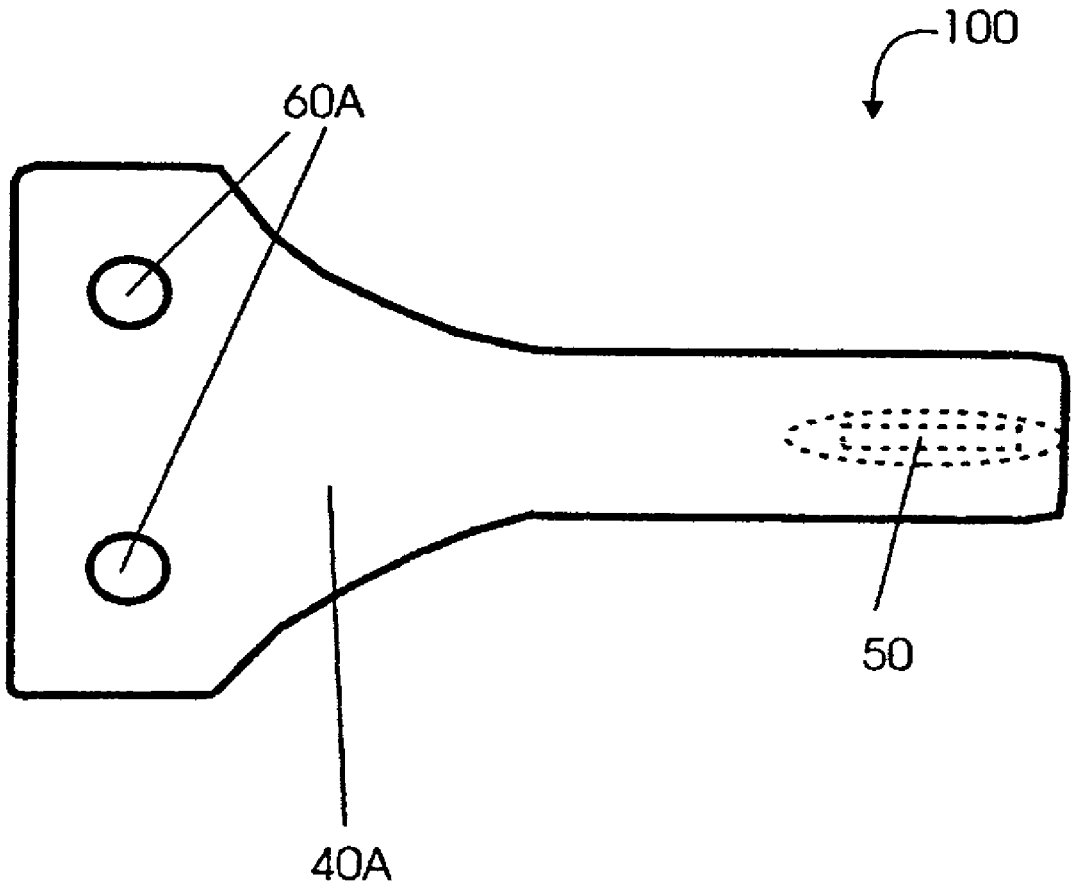
FIG. 1 shows a first embodiment of the reed switch device, having a reed switch internally imbedded inside an impact unit.

Several different embodiments, not drawn to scale, are shown in FIGS. 1–16, illustrating some of the concepts of the invention. FIG. 1 is a first embodiment of the invention, and generally shows a reed switch device 100 including an impact unit 40A and at least one reed switch 50 (shown in phantom view).

The impact unit 40A is preferably arranged and designed to stop the movement of another object—e.g., a door. The use of an impact unit 40A should be apparent to one of ordinary skill in the art. For example, the impact unit 40A can be a door stop mounted to a door track of a roll-up door, with the impact unit 40A being generally arranged and designed to prevent the roll-up door from rolling up too far. Or, the impact unit 40A can be a gate stop (with the door being a gate), arranged and designed to prevent a swinging gate from moving beyond a specified swing location. Additionally, the impact unit 40A can be a door stop in a house, arranged and designed to prevent a door from swinging past a predetermined location. To the extent foreseeable, other uses of an impact unit should become apparent to those of ordinary skill in the art.

The impact unit 40A can be coupled to the door facing, using a coupling facilitator 60A, which should become apparent to one of ordinary skill in the art. For example, in FIG. 1, the coupling facilitator 60A are attachment holes—enabling connection via a screw, bolt, rivet or other connector. In other embodiments, the coupling can be accomplished using welding, soldering, nailing, or the like.

Internally mounted inside the impact unit 40A of this embodiment is at least one reed switch 50. Such a reed switch 50, as discussed in the background of the invention, should become apparent to one of ordinary skill in the art. While only one reed switch 50 is shown in the embodiment of FIG. 1, it is to be understood that other embodiments can include one or more reed switches.

The choice of material for the impact unit 40A can vary with design and intended use. As the reed switch 50 activates upon exposure to a magnetic field, in some embodiments, the material for the impact unit 40A can be of such a nature that it minimizes interference with the exposure of the reed switch 50—yet strong and rigid enough to stop the above mentioned moving object (e.g., the door).

In some embodiments, the reed switch 50 can include a buffer surrounding and facilitating the protection of the reed switch 50. One such buffer is described in U.S. Pat. No. 5,723,835, issued to Gilmore, which is owned by the applicant of the current application and is herein incorporated in its entirety. In such embodiments, the buffer can include resilient material, made of any material known for its ability to absorb mechanical energy, namely poly-foam, polystyrene, silicone, polymers and the like. In other embodiments, the buffer can include a gas blend placed inside the resilient material, which fluidly isolates the reed switch. Such a gas blend can help suspend the reed switches to help prevent breakage of the reed switch. One such gas blend is an ammonia methanol by-product produced from curing of silicone, when silicone is used as the resilient material. In still other embodiments the buffering of the reed switch can include a material, which can absorb mechanical energy, placed on the outside of the reed switches. Such materials can include shrink-wrapped plastic, a rubber coating, or the like.

FIGS. 2 and 3 illustrate another embodiment of the invention, generally showing a reed switch device 100 with an impact unit 40B and a reed switch 50 coupled thereto (shown in phantom view). In this embodiment, the impact unit 40B can, but need not necessarily be designed to support a reed switch 50. For example, some impact units 40B can purely be designed to stop the moving object (for example, a door) mentioned with reference to FIG. 1. Other impact units 40B can be arranged and designed to have a reed switch 40B mounted, thereto. In either of these impact units 40B, a coupling apparatus 70B can be utilized to facilitate the coupling of the reed switch housing 90B (housing one or more reed switches 50) to the impact unit 40B.

The coupling apparatus 70B, in this embodiment, includes a mounting device 80B and the reed switch housing 90B. In other embodiments, the coupling apparatus can only include a mounting device 80B, while in yet still other embodiments, the coupling apparatus 70B can include only the switch housing 90B. The ultimate arrangement and design can depend upon the impact unit 40B and/or the reed switch housing 90B, including the reed switch(es) 50. Similar to the embodiment described with reference to FIG. 1, the reed switch housing 90B can include a buffer and/or buffers to absorb some of the impact and force, imparted on the impact unit 40B. Additionally, the buffer and/or buffers can be placed on the impact unit 40B.

The mounting device 80B in this embodiment includes a clamp 82B and one ore more attachment screws 86B. The switch housing 90B in this embodiment is arranged and designed to receive the attachment screw 86B of the mounting device 80B. As can be seen with this embodiment, the coupling apparatus need not be invasive to the impact unit 40B.

Figure 5:
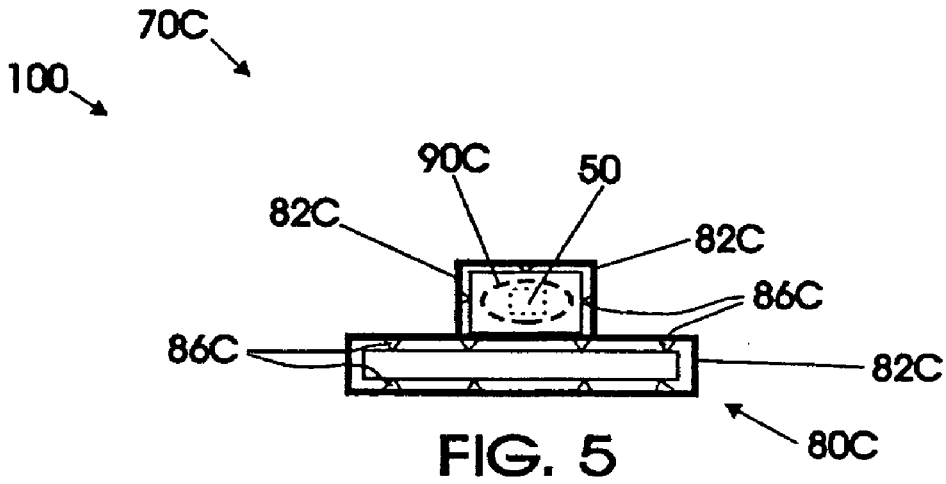
FIG. 5 is a view taken along line 5—5 of FIG. 4.
Figure 4:
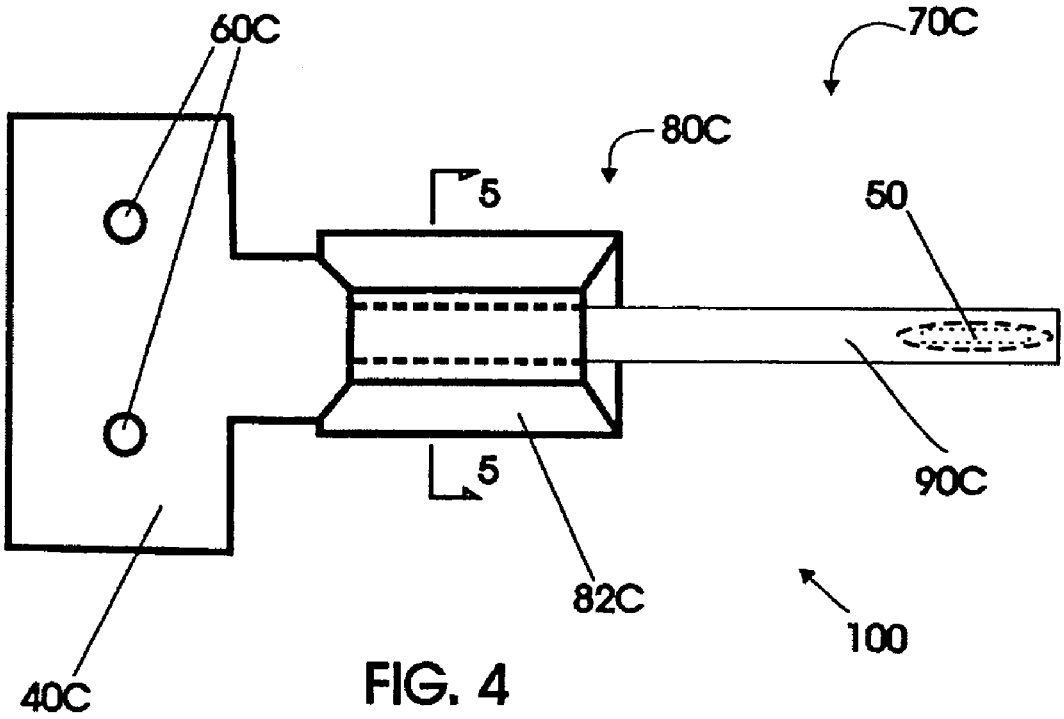
FIG. 4 shows another embodiment of the invention, having a reed switch coupled to an impact unit.

FIGS. 4 and 5, illustrative of another embodiment of the invention, shows an alternative coupling apparatus 70C. This embodiment can function in a similar manner to the embodiment described with reference to FIGS. 2 and 3, except that the coupling apparatus 70C in this embodiment includes a clip 82C, which can include teeth 86C. The clip 82C, as shown in this embodiment, can surround both the switch housing 90C and the impact unit 40C, utilizing the teeth 86C to hold the switch housing 90C and impact unit 40C in place. Once again the reed switch 50 is shown in phantom view.

Figure 6:
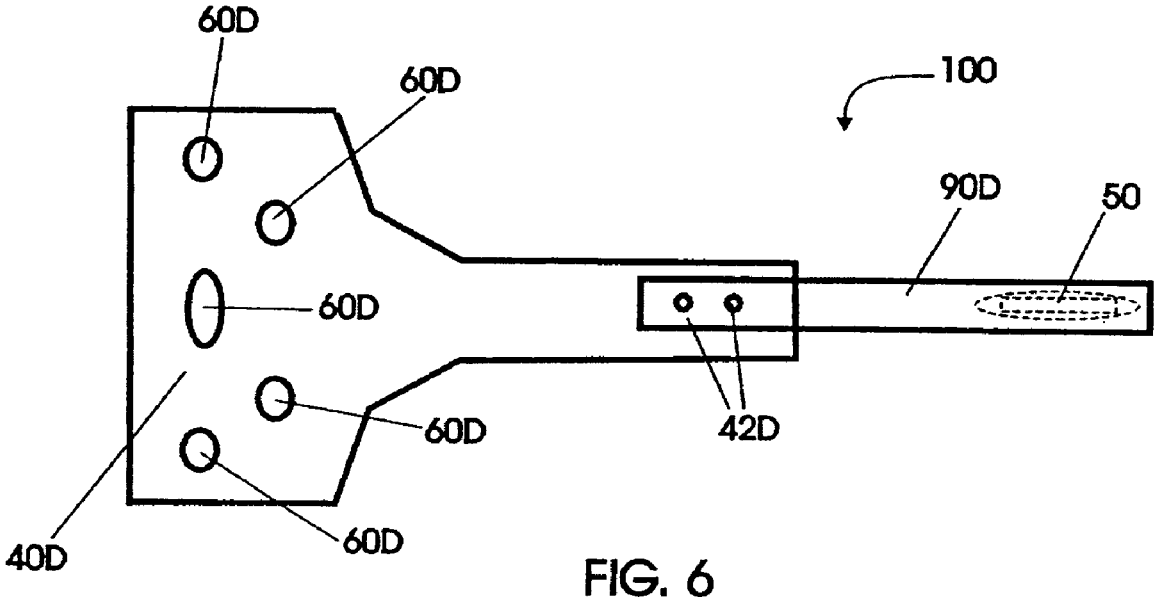
FIG. 6 shows another embodiment of the invention, having a reed switch coupled to an impact unit.
Figure 8:
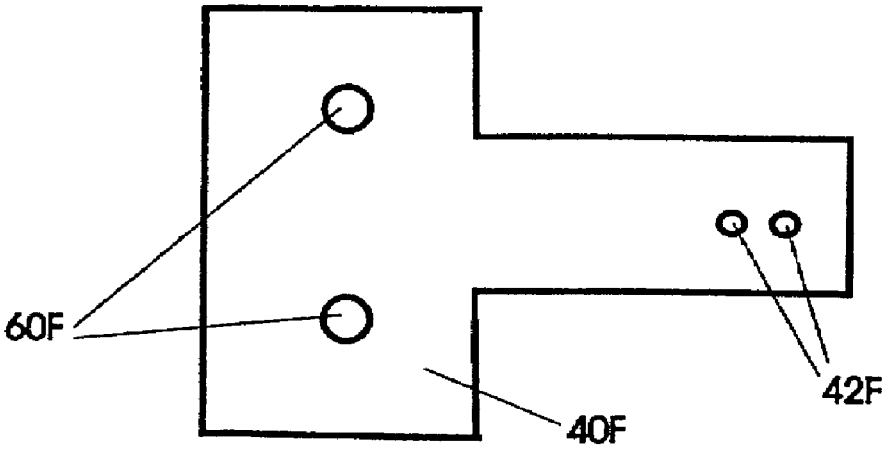
Figure 7:
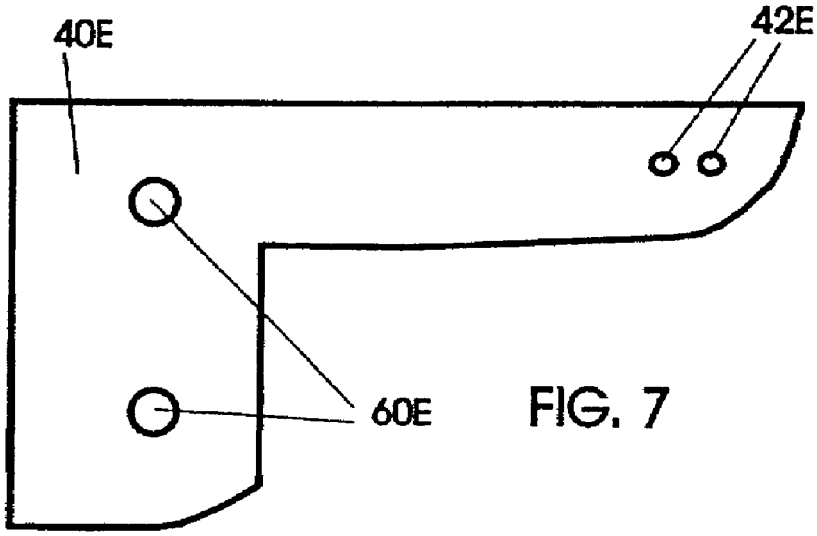
Figure 10:
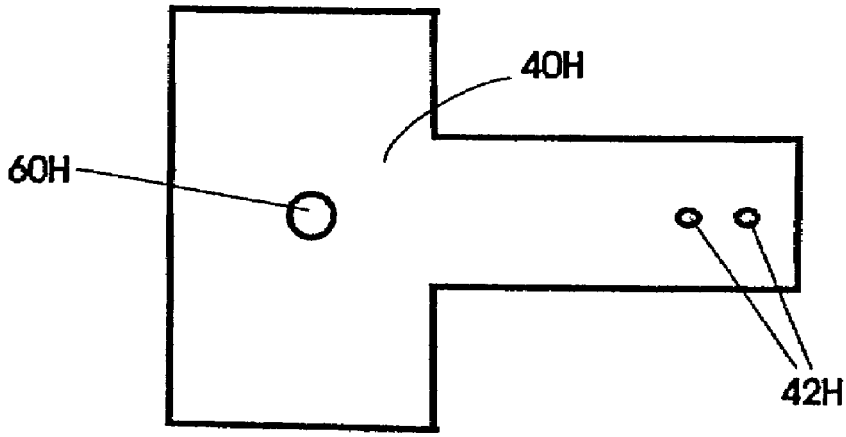
Figure 9:
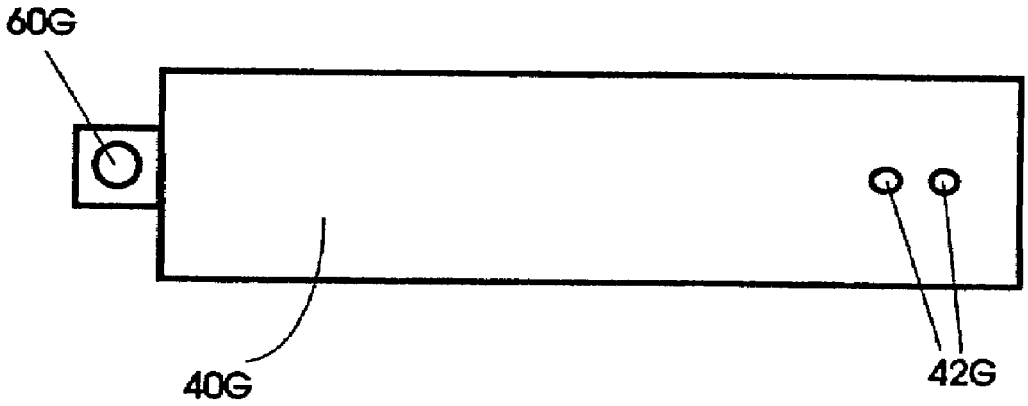
Figure 14:
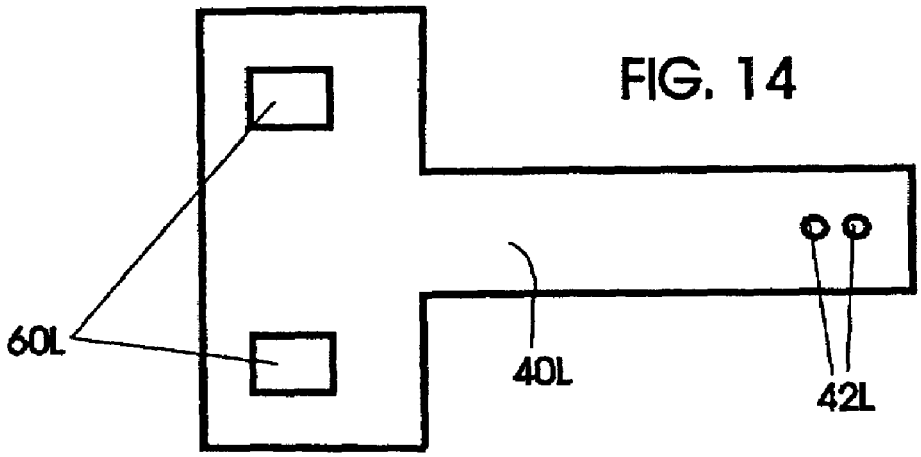
Figure 13:
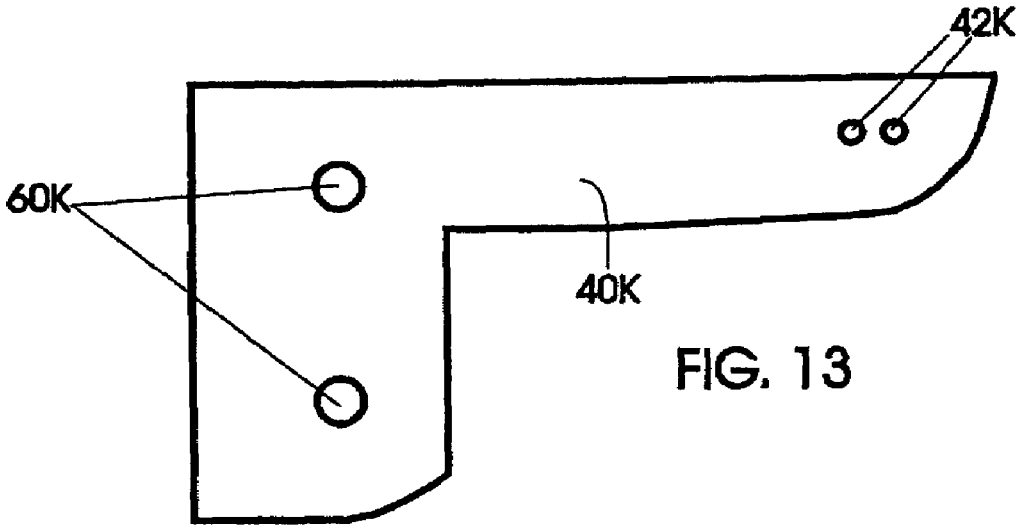

FIG. 6 shows another embodiment of the invention with the reed switch 50 (shown in phantom view) coupled to the impact unit 40D. In this embodiment, the switch housing 90D, surrounding the reed switch 50, is coupled to the impact unit 40D via attachment holes 42D. In other embodiments, the reed switch 50 can be coupled to the impact unit 40D without the housing 90D. The general coupling of the switch housing 90D, including reed switch 50, to the impact unit 40D can include one of many techniques, which should become apparent to one of ordinary skill in the art—for example, including but not limited to utilizing rivets, bolts, nuts, screws, and the like. In some embodiments, a coupling apparatus 70 can be utilized. In others, a coupling apparatus need not be utilized. Similar to the embodiments described herein, the switch housing can include a buffer.

FIGS. 7–16 generally show some of the other embodiments for the impact unit 40—e.g., 40E, 40F, 40G, 40H, 40I, 40J, 40K, 40L, and 40M, generally having attachment holes 42E, 42F, 42G, 42H, 421, 42J, 42K, 42L, and 42M and coupling facilitators 60E, 60F, 60G, 60H, 60I, 60J, 60K, 60L, and 60M. These embodiments are only illustrative of some of the several configurations which can be utilized for the impact unit 40 as others should become apparent, to the extent foreseeable, to one of ordinary skill in the art.

With regard to the embodiments, described herein—in general—as well as other embodiments which should become apparent to one of ordinary skill in the art, some embodiments of the impact unit 40 can initially be arranged and designed to couple with a reed switch 50 (that is, during fabrication of the coupling apparatus), while other embodiments of the impact unit 40 that are not initially designed to couple with a reed switch 50 can be adapted so they can couple with a reed switch 50. With either of these types of embodiments, a kit can be utilized enabling the coupling of the reed switch 50 to the impact unit 40. This kit can include among other things, the above-mentioned coupling apparatus 70 and a buffer.

Figure 17:
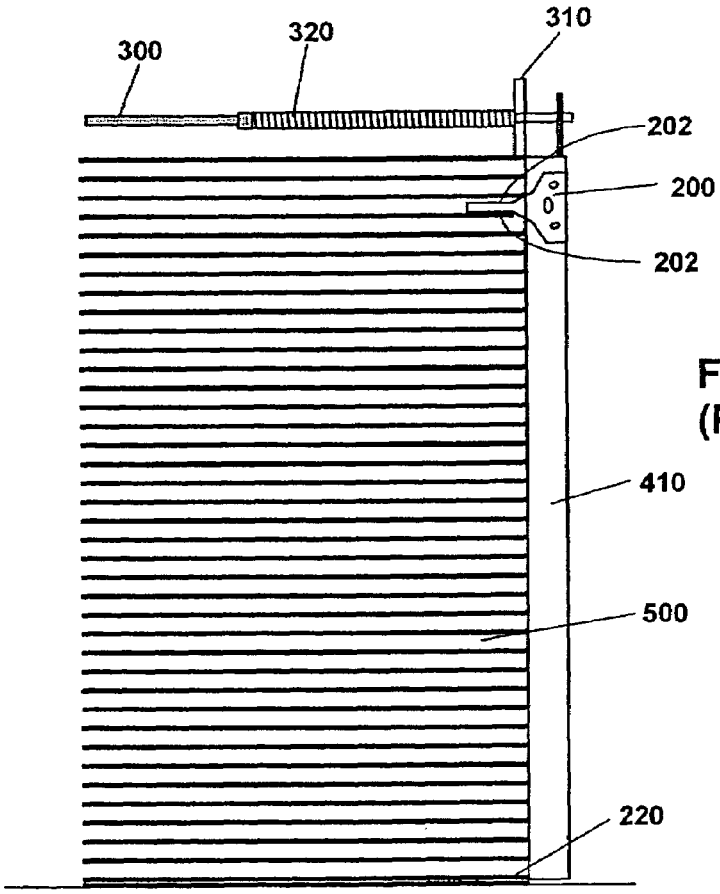
FIG. 17 (Prior Art)
FIG. 17 is a configuration in which the reed switch device can be utilized.
Figure 18:
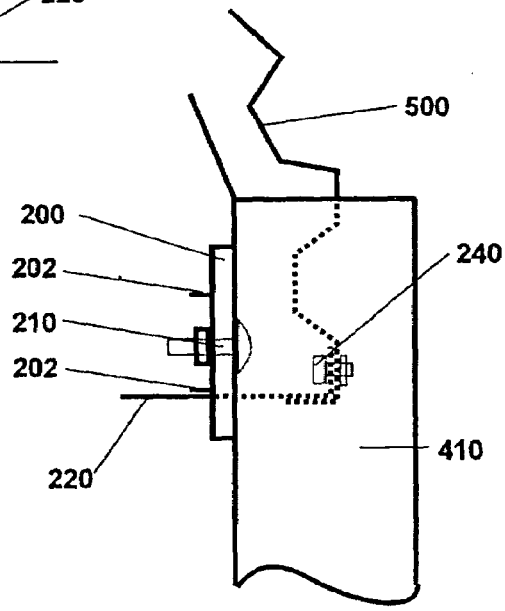
FIG. 18 (Prior Art)
FIG. 18 is another view of the configuration of FIG. 17.

FIGS. 17 and 18 generally show one of many configurations in which some of the embodiments can be utilized. A door 500 of the roll-up type is shown. Enabling movement of this door 500 is a portion of a door facing 410, which generally has a door track upon which the door 500 slidably moves. The door 500 in this embodiment is flexible enough to move from a vertically closed position to its rolled-up position at the top of the door facing 410. Furthermore, the door 500 is corrugated permitting it to coil up on a rotatable support rod 300. A disc 310 is mounted on each end of the rotatable support rod 300 for retaining each end of the door 500 as it is wound up by spring tension on the spring 320. Items typically used in such roll-up doors are also shown, including a door stop 200 (which serves as the impact unit 40 referenced in the embodiments of the invention), which prevents the door 500 from further rotation around support rod 300 when a door plate 220 on the bottom of the door 500 comes in contact with a contact edge 202 of the door stop 200. The door stop 200 includes two contact edges 202, which as known in the art, allows the door stop 200 to be mounted on the door facing 410 at either the left or right side of the door 500.

FIG. 18 shows the door 500 being stopped by the door stop 200. The bottom portion of the door 500 is shown partially in phantom view through the door facing 410. The above-mentioned door plate 220 is typically coupled to the bottom portion of the door 500 via a bolt and screw configuration 240. The door stop 200, as mentioned above, is typically mounted to the door facing 410 via another bolt and screw configuration 210. The bottom contact edge 202 of the door stop 200 extends from the door facing 410 and contacts the door plate 220—as shown here—preventing the door 500 from further rolling up and around the above-mentioned support rod 300 (shown in FIG. 17).

FIGS. 19 and 20 show an illustrative embodiment of one use of the reed switch device 100 in a configuration such as that described in FIGS. 17 and 18. The illustrated use is intended to only be explanatory thereof and is not intended to preclude other uses, which are available to the extent foreseeable by one of ordinary skill in the art. In the embodiment of FIGS. 19 and 20, the preferred design is to mount the reed switch 50 via utilization of an existing part or parts of the roll-up door 500—e.g., the parts identified with reference to FIGS. 17 and 18. In this pre-existing part selection, the door stop 200 (FIGS. 17 and 18) is a particularly viable candidate as it is not only on the correct side of the door 500 (for security system installation purposes), but it also falls within the travel path of the door curtain—something of interest when placing a magnet, arranged and designed to interact with the reed switch 50, on the door 500. Furthermore, the majority—if not all—roll-up doors 500 (of the type which a door curtain rolling into a coil) have a door stop 200. Additionally, while these rollup-up doors 500 may be in different configurations and have different door stops 200, the door stop 200 is typically mounted in a consistent location via a bolt and screw configuration 240 (FIG. 18) or the like. As such, the utilization of the door stop 200 (and/or mounting) can allow a consistent location for all roll-up doors to hold or house the reed switch 50. For example, if the reed switch 50 is to be mounted to a configuration such as that shown in FIG. 18, the mounting holes used to mount door stop 200 or the door stop 200 itself, can be utilized. By utilizing these existing parts, there is no need for invasive attachment hardware on the door facing 410 for mounting the reed switch 50. Additionally, with this preferred embodiment, a roll-up door manufacturer will not and need not make any design or installation procedure changes to accommodate a reed switch 50, while still have a smooth functioning door 500—that is, a door 500 free from interruption which could be imparted by additionally added hardware or the like.

The embodiment of the reed switch device 100 in FIGS. 19 and 20 applies the above-mentioned concept of utilizing of pre-existing part or parts of the roll-up door 500. In this embodiment, the reed switch device 100 is coupled to a portion of the door facing 410 and generally includes an impact unit 40N and at least one reed switch 50. Other items facilitating this coupling can include attachment holes 42N, coupling facilitators 60N, and a housing 90N. While the reed switch device 100 is shown coupled to a particular location of the door facing 410, it is to be understood that the impact unit 40, as described herein with reference to several embodiments as well as embodiments which should become apparent, to the extent foreseeable by one of ordinary skill in the art, can couple at several different locations on the door facing, depending on design and configuration. In this embodiment, and as described above, the reed switch device 100 is generally shown mounted in the roughly the same location of where the door stop 200 of FIG. 17 is located. As such, the reed switch device 100 can utilize the impact unit 40 to serve in a similar manner to the door stop 200—that is, stopping the upward movement of the door 500. For example, the impact unit 40N can include contact edges 202', similar to contact edges 202, discussed with reference to FIG. 17. Furthermore, the utilization of the reed switch device 100 should not interrupt the normal movement of the door 500 in rolling up and down.

The utilization of the reed switch device 100 (including the reed switch 50) can eliminate intrusiveness on the door facing 410. For example, the reed switch device 100 in some embodiments can replace a door stop 200, not generally designed to hold a reed switch 50. Thus, instead of the door facing 410 having both a reed switch 50 and a door stop 200 (see FIG. 17) mounted thereto, each at different locations, only one reed switch device 100 can be utilized. In other embodiments, a door stop 200 (see e.g., FIG. 17) can be utilized as the mounted apparatus 40 with a reed switch 50 coupled thereto—some configurations using a coupling apparatus 70 and other configurations not utilizing a coupling apparatus 70.

With the discussion of this one specific configuration of a door facing 410, it should be expressly understood that the door facing 410 can generally include a structure in communication with a door. For example, where the door is a gate hingeably connected to a fence, the door facing can be the portion of the fence opposite the hinge, of which the gate becomes flush therewith when the gate is closed. Furthermore, as discussed above, the door 500 in other embodiments can be other configurations—e.g., a swing gate, a hingeable door or the like.

As an example of the use of the reed switch device 100, intended for illustrative purposes only, the reed switch device 100 as mentioned above can stop the door 500 from moving. As the reed switch device 100 also includes at least one coupled reed switch 50, the reed switch device 100 can facilitate the communication of the door with systems indicating when the door has "changed its state"—for example, opened or closed. For example, when the door 500 is completely closed, a magnetic field generator 520 (in this embodiment, shown as a permanent magnet glued to the door) is within close proximity to the reed switch 50 of the reed switch device 100 (seen in FIGS. 717–18)—thus exposing a magnetic field on the reed switch 50. This magnetic field generator 520, forces the reed switch 50 to either close a circuit or opened a circuit (depending on whether each of the reed switches 50 is a normally open reed switch or a normally closed reed switch 40). The opening or closing of the circuit initiates communication with an outside system by either shutting off a signal being communicated or enabling a signal to be communicated.

FIG. 20 is a cross section of FIG. 19 cut across lines 20—20, showing in a different view how the reed switch device 100 can come in close proximity with the magnetic field generator 520. In this view, as an example, the reed switch 50 in the reed switch device 100 would be active or in a "normal" state as the magnetic field generator 520 is within close proximity to the reed switch 50. As the door 500 rolls up and around disc 310, the magnetic field generator 520 moves out of close proximity and the reed switch 50 is no longer activated.

The installation of the reed switch device 100, as briefly mentioned above can be accomplished in a variety of manners, depending on the type of impact unit 40 and the type of reed switch 50 being utilized. If the impact unit 40 is not specifically designed to couple with a reed switch 50, then in one embodiment the coupling apparatus can be adapted for coupling. For example, mounting holes 42 can be attached thereto. Alternatively, or in addition to such adaptation of the reed switch 50, the reed switch 50 can be coupled to the impact unit 40 via one of many techniques, which should become apparent to one of ordinary skill in the art—for example, including but not limited to utilizing rivets, bolts, nuts, screws, and the like. Additionally, in some embodiments, a coupling apparatus 70 can be utilized—including the utilization of items, including but not limited to the reed switch housing 90 and a mounting device 80. Furthermore, in some embodiments to facilitate the protection of the reed switch 50, a buffer (as described above) can be utilized.

The foregoing disclosure and description of the invention are only illustrative and explanatory thereof. Various changes in the details of the illustrated apparatus and construction and method of operation and installation may be made to the extent foreseeable without departing from the spirit of the invention.

I claim:

1. A reed switch device adapted to couple to a portion of a door facing, the door facing communicating with a door, comprising:

an impact unit adapted to stop a moving door upon impact with said impact unit;

a reed switch coupled to said impact unit; and a buffer for impact protection of said reed switch, said buffer comprised of a mechanical energy-absorbing material.

2. The reed switch device of claim 1, wherein the coupling of said reed switch to said impact unit comprises a coupling apparatus.

3. The reed switch device of claim 2, wherein said coupling apparatus includes a mounting device.

4. The reed switch device of claim 2, wherein said coupling apparatus includes a housing surrounding said reed switch.

5. The reed switch device of claim 4, wherein said coupling apparatus further includes a mounting device.

6. The reed switch device of claim 1, wherein a portion of said impact unit is adapted to support said reed switch.

7. The reed switch device of claim 1, wherein the door includes a magnetic field generator mounted thereto, the magnetic field generator interacting with said reed switch.

8. A reed switch device adapted to couple to a portion of a door facing, the door facing communicating with a door, comprising:

a reed switch;

a buffer for impact protection of said reed switch, said buffer comprising a resilient material; and an impact unit; arranged and designed to stop a moving door upon impact with said impact unit, wherein a portion of said impact unit is adapted to couple with said reed switch.

9. The reed switch device of claim 8, wherein the coupling of said reed switch to said impact unit comprises a coupling apparatus.

10. The reed switch device of claim 9, wherein said coupling apparatus includes a mounting device.

11. The reed switch device of claim 9, wherein said coupling apparatus includes a housing surrounding said reed switch.

12. The reed switch device of claim 11, wherein said coupling apparatus further includes a mounting device.

13. The reed switch device of claim 8, wherein the door includes a magnetic field generator mounted thereto, the magnet field generator interacting with said reed switch.

14. In a door configuration, having a door and a door facing, the door facing communicating with the door, wherein the door facing is arranged and designed for an impact unit to be mounted to a portion thereof, the improvement comprising:

an impact unit for mounting to the door facing;

a reed switch;

a mechanical energy absorbing buffer for impact protection of said reed switch; and a coupling apparatus, which couples said reed switch to said impact unit.

15. The door configuration of claim 14, wherein said impact unit is a pre-existing part on the door facing, and said coupling apparatus adapts said impact unit to couple with said reed switch.

16. The door configuration of claim 14, wherein a portion of said impact unit is adapted to support said reed switch.

17. The door configuration claim 14, wherein said coupling apparatus includes a mounting device.

18. The door configuration of claim 14, wherein said coupling apparatus includes a housing surrounding said reed switch.

19. The door configuration of claim 18, wherein said coupling apparatus further includes a mounting device.

20. A method of installing a reed switch device in a door configuration, generally having a door and a door facing, the door facing communicating with the door, the method comprising the steps of:

coupling a reed switch to an impact unit;

buffering the reed switch with a mechanical energy absorbing material for impact protection; and mounting the impact unit to the door facing, wherein the impact unit is arranged and designed to stop a moving door upon impact with the impact unit.

21. The method of claim 20, further comprising the step of:

utilizing a pre-existing part of the door facing or said step of mounting the impact unit to the door facing.

22. The method of claim 20, wherein the impact unit is a pre-existing part of the door facing, further comprising the step of:

adapting the impact unit to enable said coupling of the reed switch to the impact unit.

23. The method of claim 20, wherein a portion of the impact unit is adapted to support the reed switch.

24. The method of claim 20, wherein said step of coupling the reed switch to the impact unit is achieved with a coupling apparatus.

25. The method of claim 20, wherein the door includes a magnetic field generator mounted thereto, the magnet field generator interacting with the reed switch.

26. In a roll-up door assembly having a roll-up door in sliding relationship with a pair of door tracks, a door stop mounted to at least one of the door tracks, the door stop adapted to receive the impact from a door member of the roll-up door as the roll-up door moves in a direction along the pair of door tracks and to stop the roll-up door from further movement in the direction along the pair of door tracks, the improvement comprising;

a reed switch;

a buffer formed of a mechanical energy-absorbing material for impact protection of said reed switch; and a coupling apparatus which couples said reed switch to the door stop, wherein said buffer promotes said reed switch from breakage upon the door stop being impacted by the door member of the moving roll-up door and stopping the further movement of the roll-up door.

27. The improved roll-up door assembly of claim 26, further comprising a magnetic field gent mounted to the roll-up door, said magnetic field generator interacting with said reed switch.

28. In a roll-up door assembly having a roll-up door in sliding relationship with a pair of door tracks, a door stop mounted to at least one of the door tracks, the door stop adapted to receive the impact from a door member of the roll-up door as the roll-up door moves in a direction along the pair of door tracks and to stop the roll-up door from further movement in the direction along the pair of door tracks, the improvement comprising:

an impact unit adapted to replace the existing door stop and mount to the door track in the same manner as the replaced door stop;

a reed switch;

a buffer formed of a resilient material for impact protection of said reed switch; and a coupling apparatus which couples said reed switch to said impact unit, wherein said buffer protects said reed switch from breakage upon the impact unit being impacted by the door member of the moving roll-up door and stopping the further movement of the roll-up door.

29. The improved roll-up door assembly of claim 28, further comprising a magnetic field generator mounted to the roll-up door, said magnetic field generator interacting with said reed switch.

30. The improved roll-up door assembly of claim 29, wherein said coupling apparatus includes a mounting device.

31. The improved roll-up door assembly of claim 29, wherein said coupling apparatus includes a housing surrounding said reed switch.

32. The improved roll-up door assembly of claim 31, wherein said coupling apparatus further includes a mounting device.

33. A roll-up door assembly for a structural unit, the assembly comprising:

a pair of door tracks mounted to the structural unit, each said door track having an upper end portion;

a roll-up door for movement along said pair of door tracks, said roll-up door having a closed position and a rolled-up position;

a rotatable support rod positioned above said pair of door tracks, said roll-up door adapted to coil around said support rod when in said rolled-up position;

a door plate affixed to a lower portion of said roll-up door;

a door stop mounted to said upper end portion of one of said pair of door tracks, wherein said door stop is adapted to contact said door plate and prevent further upward movement of said roll-up door when moving to said rolled-up position;

a reed switch device mounted to said door stop, said reed switch device including a reed switch and a buffer adapted to absorb mechanical energy; and a magnetic field generator mounted to said roll-up door, said magnetic field generator adapted to interact with said reed switch when said roll-up door is in said closed position.

34. The roll-up door assembly of claim 33, wherein said reed switch device is externally mounted to said door stop.

35. The roll-up door assembly of claim 33, wherein said magnetic field generator is mounted directly to said roll-up door.

36. The roll-up door assembly of claim 33, wherein said magnetic field generator is mounted to an upper portion of said roll-up door.

37. The roll-up door assembly of claim 33, wherein said door plate is retrained from movement relative to said roll-up door.

38. The roll-up door assembly of claim 33, wherein said buffer is a resilient material.

39. The roll-up door assembly of claim 38, wherein said resilient material is poly-foam, polystyrene, silicone, or rubber.

40. The reed switch device of claim 1, wherein said reed switch is internally mounted in said impact unit.

41. The method of claim 20, wherein said step of coupling a reed switch to an impact unit comprises internally mounting the reed switch in the impact unit.

* * * * *